US009369795B2

(12) United States Patent
Anderson et al.

(10) Patent No.: US 9,369,795 B2
(45) Date of Patent: Jun. 14, 2016

(54) CONSOLE COMPATIBLE WIRELESS GAMING HEADSET

(71) Applicant: Logitech Europe S.A, Lausanne (CH)

(72) Inventors: Jeffrey Anderson, Camas, WA (US); Patrick Nicolet, Mountain View, CA (US)

(73) Assignee: LOGITECH EUROPE S.A., Lausanne (CH)

( * ) Notice: Subject to any disclaimer, the term of this patent is extended or adjusted under 35 U.S.C. 154(b) by 0 days.

(21) Appl. No.: 14/462,110

(22) Filed: Aug. 18, 2014

(65) Prior Publication Data

US 2016/0050485 A1 Feb. 18, 2016

(51) Int. Cl.
*H04R 1/10* (2006.01)

(52) U.S. Cl.
CPC ..... *H04R 1/1091* (2013.01); *H04R 2420/07* (2013.01)

(58) Field of Classification Search
None
See application file for complete search history.

(56) References Cited

U.S. PATENT DOCUMENTS 7,245,737 B2 7/2007 Amae et al.
7,406,172 B2 7/2008 Amae
7,424,125 B2 9/2008 Amae et al.
7,808,962 B2 * 10/2010 Slamka ..... G06F 3/16 370/310
7,940,924 B2 5/2011 Amae
8,170,261 B2 5/2012 Danielson et al.
8,270,616 B2 9/2012 Slamka et al.
2005/0124414 A1 * 6/2005 Hussaini ..... A63F 13/02 463/35
2006/0283310 A1 * 12/2006 Bicker ..... G10H 1/0066 84/645
2007/0101039 A1 * 5/2007 Rutledge ..... G06F 1/1632 710/303
2010/0020983 A1 * 1/2010 Waites ..... H04R 5/04 381/79
2010/0285750 A1 * 11/2010 Simonelic ..... H04R 5/033 455/41.3
2012/0082333 A1 4/2012 Amae
2012/0140974 A1 6/2012 Danielson et al.
2012/0203949 A1 * 8/2012 Benhard ..... G06F 13/14 710/303
2013/0045632 A1 * 2/2013 Lai ..... H01R 13/6641 439/626

* cited by examiner

*Primary Examiner* — Paul Huber
(74) *Attorney, Agent, or Firm* — Patterson & Sheridan LLP.

(57) ABSTRACT

Embodiments of the disclosure may provide a low cost audio system including a dock and a dongle. The dock may be passive and may include a plurality of inputs and a plurality of outputs. The outputs of the plurality of outputs may be connected to a single output port, which may be configured to be communicatively coupled with the dongle. The plurality of inputs of the dock may be connected to one or more audio outputs of one or more gaming consoles. The dongle may be configured to be wirelessly connected to a headset and may include a plurality of contacts that are configured to be connected to the plurality of outputs when the dongle is communicatively coupled to the port. The dongle may be also configured to be communicatively coupled to gaming platforms other than the gaming consoles that are connected to the dock.

20 Claims, 4 Drawing Sheets

CONSOLE COMPATIBLE WIRELESS GAMING HEADSET

BACKGROUND

1. Field

Embodiments disclosed herein generally relate to audio devices, and more specifically to a system that allows a wireless headset to be easily transferred between various gaming platforms.

2. Description of the Related Art

Evolution of gaming has created the need for more advanced audio and communication solutions. A gamer wishing to utilize a personal headset during game play wants a better audio experience without the need to be physically tethered to a single gaming platform, such as a personal computer (PC), a gaming console from Microsoft®, Sony®, Nintendo®, or any other gaming platform. In addition, there are more multiplayer games that allow multiple players to play in the same game environment at the same time. For these multiplayer games, players at remote locations have the ability to converse with each other, sometimes referred to as chat audio, and listen to game audio simultaneously through the use of a single headset. Many gaming platforms separately provide both chat audio and game audio through multiple different connectors that are typically separately wired to a headset. For example, for PlayStation® 3, the game audio stream is through an RCA connection located in the back of the console and the chat audio stream is through an USB connection located in the front of the console. Thus, in order to receive both game audio and chat audio, the headset is connected to both the USB connector (i.e., digital signal connector) and the RCA connector (i.e., analog signal connector), and the headset electronics mix the two audio streams. If a gamer then wishes to use the headset to play a game on a different game console, he/she would unplug the USB and RCA connections, and then reconnect the headset to the USB and RCA connections on a different console. Alternately, if a gamer wishes to use the headset to play a game on a PC, he/she would unplug the USB and RCA connections from the first console, and then connect the headset to a USB connector on the PC, which is typically configured to transmit both game and chat audio streams through the USB connection.

Therefore, there is a need for an improved audio system that allows a user to easily and rapidly move an audio receiving headset between many different types of gaming and/or PC platforms. Moreover, there is also a need for a wireless audio receiving headset that can be moved between game consoles and/or PC type platforms without the extra costs of duplicating the electronics for all the connected systems.

SUMMARY

Embodiments of the disclosure may provide a low cost audio system including a dock and a dongle. The dock may be passive and may include a plurality of inputs and a plurality of outputs. The outputs of the plurality of outputs may be connected to a single output port, which may be configured to be communicatively coupled with the dongle. The plurality of inputs of the dock may be connected to one or more audio outputs of one or more gaming consoles. The dongle may be configured to be wirelessly connected to a headset and may include a plurality of contacts that are configured to be connected to the plurality of outputs when the dongle is communicatively coupled to the port. The dongle may be also configured to be communicatively coupled to gaming platforms other than the gaming consoles that are connected to the dock.

In one embodiment, an audio system is disclosed. The audio system includes a docking element including a plurality of input ports and an output port, and the output port includes two or more output connectors. The audio system further includes a dongle having a plurality of dongle contacts disposed at an end, and a contact disposed within each of the two or more output connectors is in electrical contact with one of the plurality of dongle contacts when the end of the dongle is positioned within the output port.

In another embodiment, an audio system is disclosed. The audio system includes a docking element, and the docking element includes a plurality of input ports configured to receive one or more audio streams, an output port including a plurality of output connectors, and a plurality of conductive traces that are each configured to transfer an electrical signal between one of the plurality of input ports and the output port. Each of the plurality of output connectors is coupled to at least one of the input ports via a conductive trace of the plurality of conductive traces. The audio system further includes a dongle that is configured to connect to the output port, and the dongle is further configured to wirelessly communicate with a wireless headset. The dongle includes a plurality of contacts, and each contact is coupled to a corresponding output connector when the dongle is connected to the output port.

In another embodiment, a method for transferring data is disclosed. The method includes transferring data from a first computing device to a docking element, the first computing device is connected to the docking element, and the docking element includes a plurality of input ports and an output port. The method further includes transferring data from the plurality of input ports to the output port via a plurality of conductive traces, and transferring data from the output port to a dongle coupled to the output port. The dongle includes a plurality of dongle contacts. The method further includes transferring data from the dongle to a wireless headset.

In another embodiment, a method for transferring data is disclosed. The method for transferring data may include receiving audio data signals from a first computing device, wherein the audio data signals are received by two or more input ports of a docking element, transferring the audio data signals from the two or more input ports to an output port of the docking element via a plurality of conductive traces, transferring the audio data signals from the output port to a dongle coupled to the output port, wherein transferring the audio data signals further comprises transferring a first portion of the audio data signals to the dongle through a first connector that is in communication with a first dongle contact and transferring a second portion of the audio data signals to the dongle through a second connector that is in communication with a second dongle contact. The method further includes transferring the audio data signals received by the first and second dongle contacts to a wireless headset.

BRIEF DESCRIPTION OF THE DRAWINGS

So that the manner in which the above recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1A:
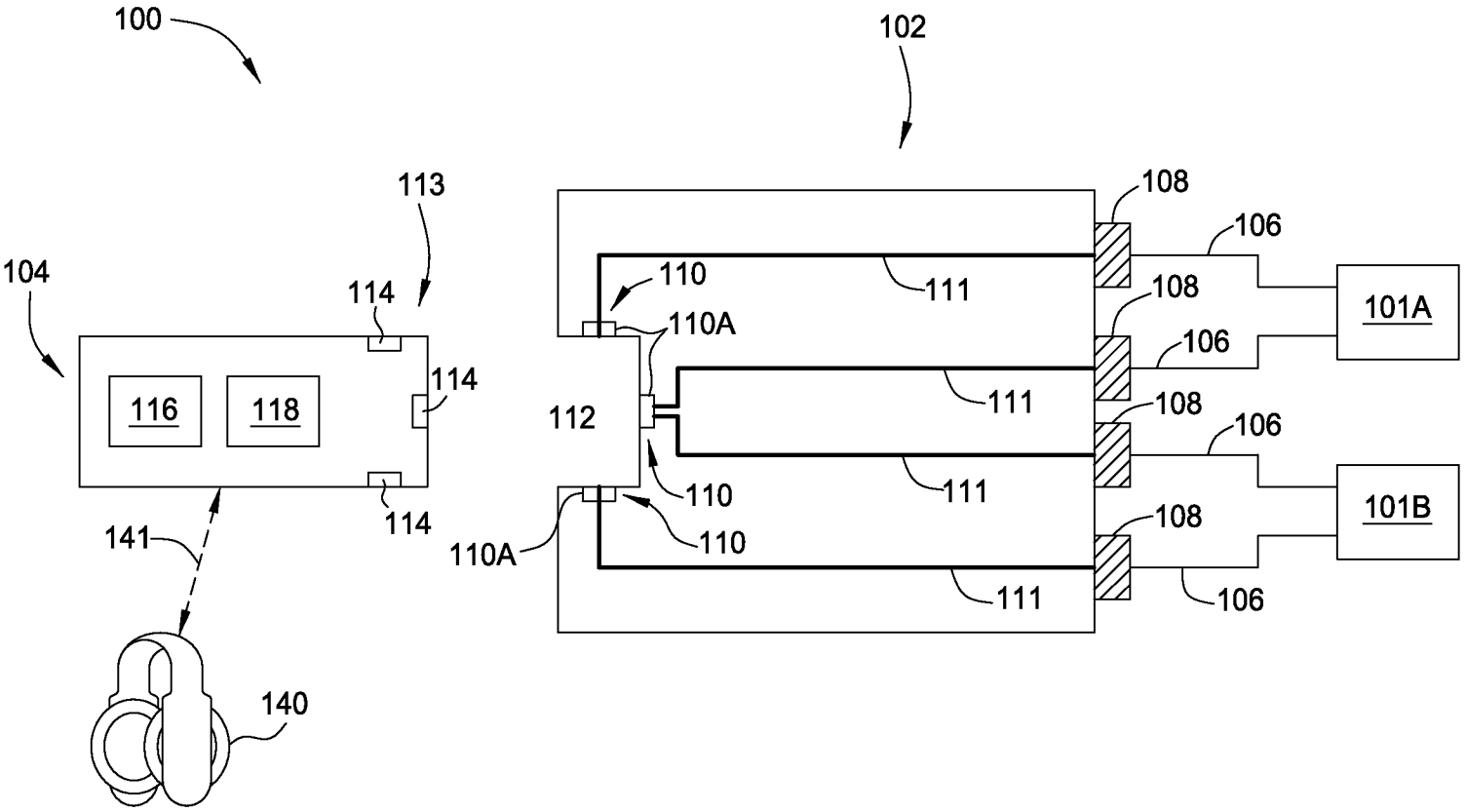
FIGS. 1A-1C are conceptual diagrams that illustrate an audio system according to embodiments of the present disclosure.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

In the following description, numerous specific details are set forth to provide a more thorough understanding of the present disclosure. However, it will be apparent to one of skill in the art that the present disclosure may be practiced without one or more of these specific details. In other instances, well-known features have not been described in order to avoid obscuring the present disclosure.

Embodiments of the disclosure may provide an audio system that includes a docking element and a dongle. In some embodiments, the docking element and dongle are used to wirelessly connect and transfer received digital and/or analog input signals to a wireless headset from one or more computing devices. The docking element, or simply the dock, includes an output port and a plurality of input ports, which are connected to the one or more computing devices. The plurality of input ports of the dock may be connected to one or more audio outputs of one or more computing devices. The output port may be communicatively coupled with the dongle. The dongle, which is configured to wirelessly connect the dock to a headset, may include a plurality of contacts that connect to one or more dock outputs formed in the dock, when the dongle is communicatively coupled to the dock. The dongle may be also configured to be communicatively coupled to other computing devices, such as other gaming platforms, that are different from the one or more computing devices that are connected to the dock. In this configuration, the dongle, and its wirelessly connected wireless headset, can be moved between different computing devices by removing the dongle from the dock and then connecting the dongle to another dock or directly to another computing device.

FIG. 1A is a conceptual diagram that illustrates an audio system 100, according to embodiments of the present disclosure. The audio system 100 may include a dock 102 and a dongle 104. The dock 102 may include a plurality of input connectors 106, which are each connected to an input port 108. Each of the input connectors 106 may be configured to receive an audio stream from one or more gaming platforms. The audio streams may be digital audio data, analog audio data or both that are received from one or more computing devices, such as computing devices 101A and 101B shown in FIG. 1A. The computing devices 101A and 101B may include different types of computing or gaming consoles, such as, for example, Wii® or Wii U® by Nintendo Corp., Xbox 360® or Xbox One® by Microsoft Corp., PlayStation® 4 or PlayStation® Vita TV by Sony Corp., Ouya by Ouya Inc., GameStick by PlayJam, MOJO by Mad Catz, GamePop by BlueStacks, Steam Machine by Valve, Xi3 Piston by Xi3, Huawei Tron by Huawei Inc., retron5 by Hyperkin, Fire TV by Amazon, desktop computer, laptop computer or other similar device. Each input connector 106 may be connected to a corresponding output connector 110, and each of the output connectors 110 include one or more contacts 110A that are positioned within the output port 112. The output port 112 may include any suitable connector(s), such as USB, mini-USB, Firewire, or HDMI connectors. However, the output port 112 may also include additional connectors or contacting elements (e.g., sliding contacts) for additional audio streams compared to a conventional connector, such as USB or HDMI connectors. In one embodiment, the output port 112 includes a USB connector, an RCA connector, a type of pin and socket connector, or other suitable electrical contacting element. A plurality of conductive traces 111 are used to connect the input ports 108 to the output port 112. A conductive trace 111 may include a wire, cable or other conductive element that is able to transfer electrical signals between an input port 108 and the output port 112. In some embodiments, the dock 102 is used to pass audio streams from the input connectors 106 to the output connectors 110 in parallel without processing the audio streams received from the one or more computing devices 101A and/or 101B. Thus, the dock 102 may be a passive element, and as such the passive dock may be produced at a minimum cost and allow the wireless headset to be easily and seamlessly transferred to computing devices other than computing devices 101A and 101B.

The dongle 104 may include an end 113 and a plurality of contacts 114 may be disposed or positioned at the end 113. The end 113 may be configured to be communicatively coupled to the output port 112 of the dock 102, and each contact 114 may be connected to a contact 110A in each of the output connector 110 when the dongle 104 is coupled to the dock 102. In other words, when the end 113 of the dongle 104 is inserted into the output port 112 of the dock 102, every contact 114 is connected to a corresponding contact 110A. The dongle 104 may include a signal converter 116 and a wireless transmitter 118. The signal converter 116 may include analog to digital converter (ADC) components that are used to convert analog audio streams, which are received from the one or more computing devices 101A and/or 101B through the dock 102, into digital audio streams. The wireless transmitter 118 may be utilized to transmit any received digital audio streams to a wireless headset. The digital audio streams received by the wireless transmitter 118 may come from the signal converter 116 and/or directly from a computing device 101A, 101B. The digital audio stream signals directly received by the wireless transmitter 118 from a computing device 101A, 101B may be received via the one or more input connectors 106, one or more conductive traces 111, one or more output connectors 110 and one or more contacts 114, which are coupled to a corresponding contact 110A in an output connector 110. The wireless transmitter 118 may employ any suitable wireless protocols that have a fast response time to communicate with the wireless headset 140 via a wireless link 141. In gaming configurations, a fast response time or rapid transfer of audio data to the wireless headset is important due to the typical amount of audio data transferred from a gaming platform and possible time lag in receiving and transmitting the audio data to the user that can affect the user's listening and game playing experience. One example of such a protocol is the Avnera Audio Link (AAL) protocol. However, other types of protocols can be used without deviating from the basic scope of the invention provided herein (e.g., Bluetooth® classic, Bluetooth LE®, etc.).

Figure 1B:
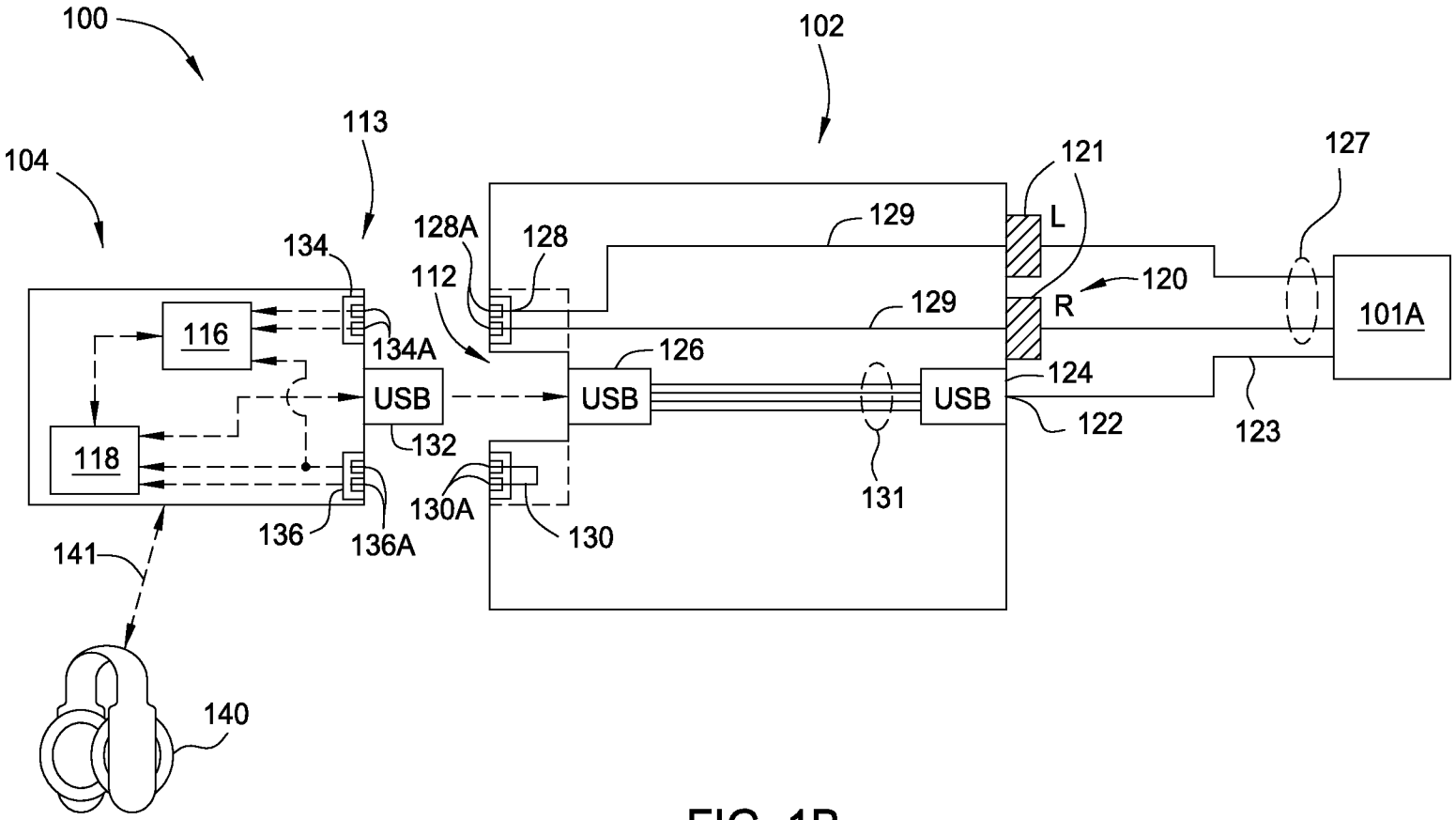

FIG. 1B is a conceptual diagram that illustrates the audio system 100 according to embodiments of the present disclosure. In one embodiment, as shown in FIG. 1B, the dock 102 includes an input element 120 that includes one or more input ports 121 and a second input element 122 that includes one or more input ports 124. The input ports 121 may be configured to form a connection with a banana plug, audio jack (e.g., 3.5 mm jack), binding post, phone connectors, XLR, TOSLINK, D-sub, S/PDIF, BNC, D-terminal, or other similar connectors. In one example, the first input element 120 is configured to receive one or more analog signals and the ports 121 may include RCA type of connectors that receives analog audio stream from an RCA cable 127 that is connected to a computing device 101A. The input element 120 is connected to the output connector 128 via one or more wires 129. The output connector 128 includes one or more contacts 128A. In this example, the second input element 122 is configured to receive a digital signal from the computing device 101A through the port 124. In one example, the port 124 may be a USB or mini-USB port that receives digital audio stream from a USB connection on the dock 102 that is coupled to the computing device 101A via a cable 123. The USB input element 122 is connected to the output connector 126 via one or more wires 131. In another example, the port 124 may be XLR, TOSLINK, D-sub, S/PDIF, BNC, D-terminal, HDMI or other similar connector. In one embodiment, the analog audio stream may be the game audio stream received from the computing device 101A, such as a PlayStation® 3, and the digital audio stream may be the chat audio stream from the computing device 101A. Additional input elements (not shown) may be located on the dock 102, and the additional input elements may be configured to receive analog and/or digital audio streams from additional gaming consoles.

In one embodiment, the dongle 104 is a modified USB dongle, as shown in FIG. 1B. The dongle 104 includes the end 113 that has a USB connector 132. In addition to the USB connector 132, a plurality of connectors 134, 136 are located at the end 113 of the dongle 104. Each connector 134, 136 includes contacts 134A, 136A, respectively. The USB connector 132 is configured to be inserted into the output port 112 of the dock 102 and to establish communication with the output connector 126. When the dongle 104 is inserted into the port 112, the USB connector 132 is communicatively coupled to the output connector 126, the connector 134 is communicatively coupled to the output connector 128 via the coupling of the contacts 134A and 128A, and the connector 136 is communicatively coupled to the output 130 via the coupling of the contacts 136A and 130A. The connector 134 is configured to pass an analog audio stream from the computing device 101A via the dock 102 to the signal converter 116. The signal converter 116 may be an ADC, which converts the received analog audio stream to a digital audio stream, and the digital audio stream is then transmitted to the wireless headset 140 by the wireless transmitter 118. Similarly, the USB connector 132 is configured to pass the digital audio stream from the gaming console to the wireless headset 140 via the dock 102 and the wireless transmitter 118. In some embodiments, an additional connector 136 formed on the dongle 104 is configured to receive a digital or an analog signal when it is connected to an alternate computing device (not shown) and/or used to detect the connection of the dongle 104 to the dock 102.

The dongle 104 is wirelessly connected to the wireless headset 140, and is communicatively coupled to one or more computing devices via the dock 102 when the dongle 104 is inserted in the port 112 of the dock 102. As a result, the wireless headset 140 can be used with any computing device that is connected to the dock 102. In addition, using the same wireless headset when switching from one computing device to another becomes much more convenient since there is no need to unplug and plug the cables connecting the computing device to the headset 140. In one example, the dongle 104 can be removed from the dock 102 and be directly inserted into a computing device, such as a PC, to allow the wireless headset to be used for playing games on the PC. In this case, the USB connector 132 of the dongle 104 can be inserted in the USB port on the PC. Again, it is much more convenient for the gamer to switch from a game played on a computing device, such as Xbox One®, to a game played on a PC while using the same wireless headset, since all the gamer has to do is to unplug the dongle 104 from the dock 102 and to insert the dongle 104 into the PC. In some configurations, the dongle 104 may be powered by the device to which the dongle 104 is connected. In one embodiment, the dongle 104 is connected to the dock 102, and the dock 102 is connected to a computing device that can power the dongle 104 via a USB power source or other suitable power source. In another embodiment, if the computing device is connected to the dock 102 and the dongle 104 via analog connection, a secondary power adaptor may be connected to the dock 102 to supply power to the dongle 104.

Figure 1C:
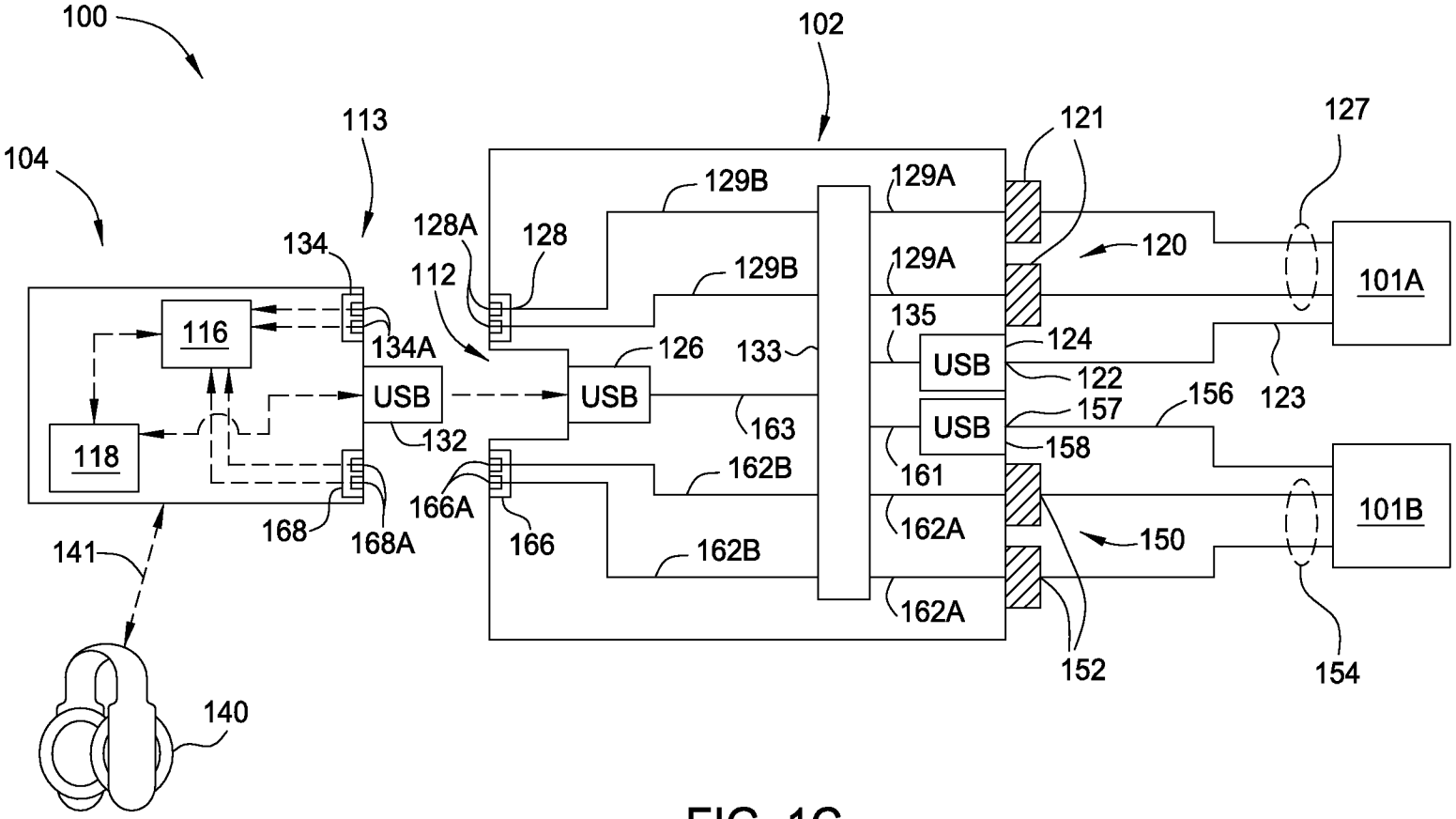

FIG. 1C is a conceptual diagram that illustrates the audio system 100 according to embodiments of the present disclosure. As shown in FIG. 1C, a second computing device 101B is connected to the dock 102 via input elements 150 and 157. The input element 150 may include one or more input ports 152 and input element 157 may include input port 158. The input ports 152 may be configured to form a connection with a banana plug, audio jack (e.g., 3.5 mm jack), binding post, phone connectors, XLR, TOSLINK, D-sub, S/PDIF, BNC, D-terminal, HDMI or other similar connectors. In one example, the input element 150 is configured to receive one or more analog signals and the ports 152 may include RCA type of connectors that receives analog audio stream from an RCA cable 154 that is connected to the computing device 101B. The input element 150 is connected to an output element 166 via one or more wire sections 162A, 162B. The input element 157 is configured to receive a digital signal from the computing device 101B through the port 158. In one example, the port 158 may be a USB or mini-USB port that receives digital audio stream from a USB connection on the dock 102 that is coupled to the computing device 101B via a cable 156. In one example, input element 157 is a USB type element that is connected to the output connector 126 via one or more wire sections 161, 163. In another example, the port 158 may be configured to connect to an XLR, TOSLINK, D-sub, S/PDIF, BNC, D-terminal, or other similar connector. A mechanical switch 133 may be disposed between the input ports 121, 124, 152, 158 and the output port 112, so audio streams from one computing device may be sent to the output port 112 at a time. Wires connecting the input port 121 and the output port 112 may each have a pre-switch section 129A and a post-switch section 129B. Wires connecting the input ports 124, 158 and the output port 112 may have pre-switch sections 135, 161 and a post-switch section 163B. Wires connecting the input port 152 and the output port 112 may each have a pre-switch section 162A and a post-switch section 162B. In one example, the mechanical switch 133 may be used to switch the inputs received by the dongle 104 from the input elements 120 and 122 received from one computing device 101A to the input elements 150 and 157 received from a second computing device 101B. The mechanical switch 133 may be disposed between the input ports 124, 158 and the output port 112. In one embodiment, the analog audio stream may be the game audio stream delivered from a computing device 101B, such as an Xbox One®, and the digital audio stream may be the chat audio stream delivered from the computing device 101B. In one embodiment, the computing device 101A is an Xbox One® and the computing device 101B is a PlayStation® 4, and the chat and game audio streams from one of the gaming consoles are passed to the dongle 104 via the dock 102. The selection of the gaming console that is to deliver audio data to the wireless head set 140 may be provided by setting the mechanical switch 133 to a desired position to receive the desired input from a desired computing device or by the dongle 104 automatically sensing the audio signals provided by the desired computing device. In this configuration, a gamer can use the same wireless headset without unplugging and plugging any cables when switching from the Xbox One® to the PlayStation® 4, as long as the dongle 104 is communicatively coupled to the dock 102.

The dock 102 includes the output port 112 configured to be communicatively coupled to the dongle 104. The output port 112 includes output connectors 126, 128, 166, which are connected to input elements 122, 120, 150, respectively. The output connectors 128, 166 may include contacts 128A, 166A, respectively. As shown in FIG. 1C, the dock 102 is a passive dock that contains a plurality of input ports 121, 124, 152, 158, an output port 112 and wire sections 129A, 129B, 135, 161, 163, 162A, 162B connecting the input ports 121, 124, 152, 158 to the output port 112. In some embodiments, no active signal modifying components are disposed within the dock 102, and thus the dock 102 does not include any signal processing capabilities. Thus, the dock 102 may be manufactured at a low cost compared to other docks that have signal processing capabilities.

In one embodiment, the dongle 104 is a modified USB dongle, as shown in FIG. 1C. The dongle 104 includes the end 113 that has a USB connector 132. In addition to the USB connector 132, a plurality of connectors 134, 168 may also be located at the end 113. The connectors 134, 168 may include contacts 134A, 168A, respectively. The USB connector 132 is configured to be inserted into the output port 112 of the dock 102 and to establish communication with the output connector 126. With the dongle 104 inserted into the port 112 and the USB connector 132 communicatively coupled to the output connector 126, the connector 134 is communicatively coupled to the output connector 128 via the coupling of the contacts 134A and 128A, and the connector 168 is communicatively coupled to the output connector 166 via the coupling of the contacts 168A and 166A. The connector 168 is configured to pass the analog audio stream from the computing device 101B via the dock 102 to the signal converter 116. The signal converter 116 in this configuration is an ADC, which converts the analog audio stream to a digital audio stream, which is then transmitted to the wireless headset 140 by the wireless transmitter 118. Similarly, the USB connector 132 is configured to pass the digital audio stream from the gaming console to the wireless headset 140 via the dock 102 and the wireless transmitter 118.

Figure 2:
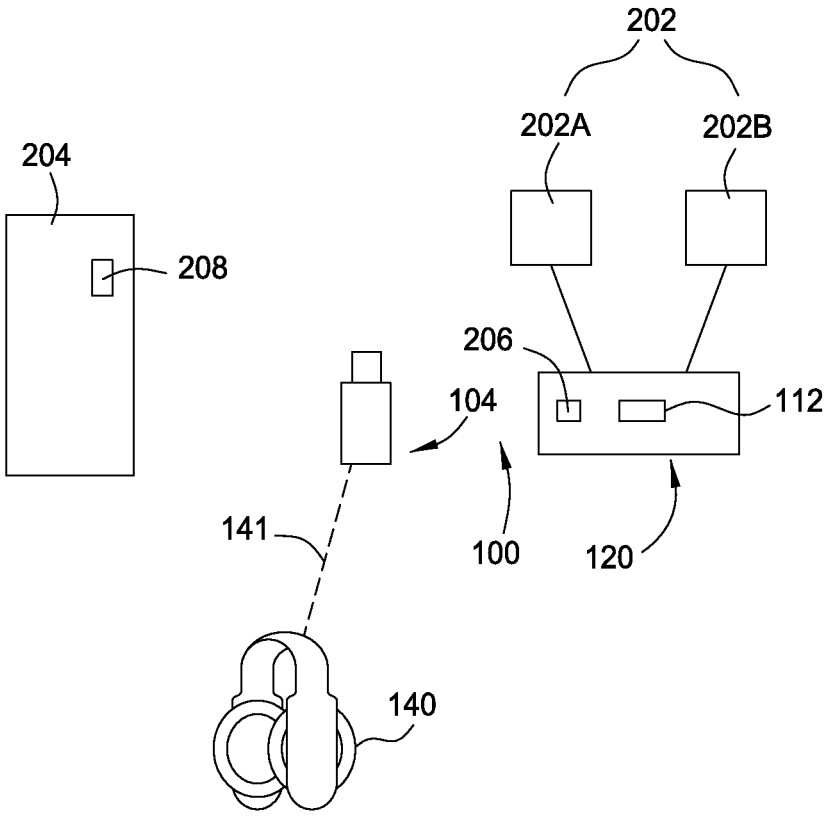
FIG. 2 is a conceptual diagram that illustrates an audio system that may be used on multiple gaming systems according to embodiments of the present disclosure.

FIG. 2 is a conceptual diagram that illustrates how the audio system 100 may be used to rapidly connect a wireless headset to multiple computing devices according to embodiments of the present disclosure. As shown in FIG. 2, the audio system 100 includes the dock 102 and the dongle 104. The dock 102 is communicatively coupled to one or more computing devices 202, such as gaming console 202A and/or gaming console 202B, and the dongle 104 is wirelessly connected to a wireless headset 140 via link 141. If a gamer wants to use the headset 140 when playing a game using one of the gaming consoles 202A or 202B, the dongle 104 is inserted in the port 112 of the dock 102. The various audio streams, such as both chat and game audio streams delivered from the gaming console 202A that the gamer is playing a game on, are transmitted to the wireless headset 140 via the dock 102 and the dongle 104. The gamer can use the wireless headset 140 to play a game on a different gaming console, such as gaming consoles 202B, without unplugging and plugging any cables to connect the wireless headset 140 to the different gaming console. A switch 206 disposed on the dock 102 may be used to block audio streams from the gaming console 202A while transmitting audio streams from the other gaming console 202B. The switch 206 may be the mechanical switch 133 shown in FIG. 1C. Alternatively, the switch between consoles can be done by turning off one gaming console and turning on the other gaming console. The gamer can also use the wireless headset 140 to play a game on a PC 204 by simply unplugging the dongle 104 from the dock 102 and plugging the dongle 104 into a USB port 208 on the PC 204. Therefore, in some examples, a dongle 104 can be used with a PC 204 that has a USB port to transmit information (e.g., digital signals) generated by the PC 204 to the wireless headset 140, and alternately the dongle 104 can be used with the dock 102 to transmit the gaming console 202A, 202B generated information (e.g., analog and/or digital signals) to the wireless headset 140.

In summary, an audio system is disclosed. The audio system includes a dock and a dongle. The dock may be connected to one or more computing devices and the dongle may be used to wirelessly connect a wireless headset to the dock. The dongle can be unplugged from the dock and plugged into a different computing device, such as a PC. Having the audio system enables a gamer to conveniently switching from one gaming platform to another gaming platform.

The disclosure has been described above with reference to specific embodiments. Persons skilled in the art, however, will understand that various modifications and changes may be made thereto without departing from the broader spirit and scope of the disclosure as set forth in the appended claims. The foregoing description and drawings are, accordingly, to be regarded in an illustrative rather than a restrictive sense.

The invention claimed is:

1. An audio system, comprising:

a docking element including a plurality of input ports and an output port, wherein the output port comprises a first digital signal connector and one or more contacts, wherein the one or more contacts are external to the first digital signal connector; and a dongle having one or more dongle contacts and a second digital signal connector, wherein the one or more dongle contacts and the second digital signal connector are disposed at an end of the dongle, wherein the one or more contacts of the output port are in electrical contact with corresponding one or more dongle contacts, and the first digital signal connector is in electrical contact with the second digital signal connector when the end of the dongle is positioned within the output port.

2. The audio system of claim 1, further comprising a wireless headset, wherein the dongle is configured to wirelessly communicate with the wireless headset.

3. The audio system of claim 1, wherein the plurality of input ports further comprise:

a first port that comprises a connector selected from a group consisting of a USB connector, mini-USB connector, Firewire connector and HDMI connector, and a second port that comprises an RCA connector.

4. The audio system of claim 1, wherein the docking element is configured to be connected to two or more computing devices via the input ports.

5. The audio system of claim 3, wherein the docking element is configured to be connected to one or more gaming consoles via the input ports.

6. The audio system of claim 3, wherein the dongle is configured to be inserted in a computer device that is not connected to the docking element.

7. The audio system of claim 5, wherein the dongle is configured to be inserted in a personal computer.

8. The audio system of claim 1, wherein the first digital signal connector is a USB connector, and the second digital signal connector is a USB connector.

9. An audio system, comprising:

a docking element, comprising:

a plurality of input ports configured to receive one or more audio streams;

an output port comprising a first digital signal connector and a plurality of contacts, wherein the plurality of contacts are external to the first digital signal connector; and a plurality of conductive traces that are each configured to transfer an electrical signal between one of the plurality of input ports and the output port, wherein each of the first digital signal connector and the plurality of contacts is coupled to at least one of the input ports via a conductive trace of the plurality of conductive traces; and a dongle that is configured to connect to the output port, wherein the dongle is further configured to wirelessly communicate with a wireless headset, and wherein the dongle includes a plurality of contacts and a second digital signal connector, wherein the plurality of contacts and the second digital signal connector are disposed at an end of the dongle, and each of the plurality of contacts and the second digital signal connector is coupled to a corresponding one of the plurality of contacts and the first digital signal connector of the output port when the dongle is connected to the output port.

10. The audio system of claim 9, wherein the plurality of input ports comprises a first input port and a second input port, wherein:

the first input port comprises a connector selected from a group consisting of a USB connector, mini-USB connector, Firewire connector and HDMI connector, and the second input port comprises an RCA connector.

11. The audio system of claim 9, wherein the docking element is configured to be connected to two or more computing devices via the input ports.

12. The audio system of claim 11, wherein the docking element is configured to be connected to one or more gaming consoles via the input ports.

13. The audio system of claim 11, wherein the dongle is configured to be inserted in a computer device that is not connected to the docking element.

14. The audio system of claim 12, wherein the dongle is configured to be inserted in a personal computer.

15. The audio system of claim 9, wherein the dongle is configured to be wirelessly connected to a wireless headset.

16. The audio system of claim 9, wherein the first digital signal connector is a USB connector, and the second digital signal connector is a USB connector.

17. A method for transferring data, comprising:

receiving audio data signals from a first computing device, wherein the audio data signals are received by two or more input ports of a docking element;

transferring the audio data signals from the two or more input ports to an output port of the docking element via a plurality of conductive traces;

transferring the audio data signals from the output port to a dongle coupled to the output port, wherein transferring the audio data signals further comprises transferring a first portion of the audio data signals to the dongle through a first digital signal connector of the output port that is in communication with a second digital signal connector disposed at an end of the dongle and transferring a second portion of the audio data signals to the dongle through one or more contacts of the output port that is in communication with one or more dongle contacts disposed at the end of the dongle, wherein the one or more dongle contacts and the one or more contacts of the output port are external to the first and the second digital signal connectors; and transferring the audio data signals received by the first and second dongle contacts to a wireless headset.

18. The method of claim 17, wherein the two or more input ports is configured to receive two or more audio streams.

19. The method of claim 17, wherein the first portion of the audio data signals comprises a digital audio stream and the second portion of the audio data signals comprises an analog audio stream.

20. The method of claim 17, further comprising transferring the audio data signals from a second computing device to the dongle by removing the dongle from the docking system and inserting the dongle in a connector formed on the second computing device.

* * * * *